United States Patent [19]

Miller

[11] 4,077,104

[45] Mar. 7, 1978

[54] REEL CONSTRUCTION AND ASSEMBLY APPARATUS

[75] Inventor: Robert M. Miller, Denver, Colo.

[73] Assignee: Denver Wood Products Co., Denver, Colo.

[21] Appl. No.: 693,065

[22] Filed: Jun. 4, 1976

[51] Int. Cl.[2] ..... B25B 27/14

[52] U.S. Cl. ..... 29/271; 29/243.5; 227/61; 269/47

[58] Field of Search ..... 29/271, 283, 243.52, 29/243.5, 243.53, 243.54; 227/61, 62; 269/48.1, 47

[56] References Cited

U.S. PATENT DOCUMENTS

| | | | |
|---|---|---|---|
| 3,216,717 | 11/1965 | Bagge et al. | 269/47 |
| 3,360,175 | 12/1967 | Stein | 227/62 |
| 3,432,925 | 3/1969 | Wooley | 29/243.54 |

*Primary Examiner*—James L. Jones, Jr.
*Attorney, Agent, or Firm*—C. B. Messenger

[57] ABSTRACT

A shipping reel for storing coiled products, such as hose, cable, rope, wire and the like, and apparatus facilitating the assembly thereof. Reel components, inclusive of side flanges and a center drum that are provided in a disassembled more compact relation, are readily assembled at a point of use. Upset ends of a plurality of through rods engage dished washers disposed in counterbored recesses of a top flange to pass through the center drum and through similar openings and counterbored recesses of a base flange. Hammer blows directed at the upper upset ends of the rods drive the rods through openings in locking washers of dished recess shape that are disposed on bushings of an assembly table supporting the base flange and staking pins disposed in the bushings and having cross chisel points slightly flare the lower ends of the rods to hold the washers, flanges and center drum in assembled relationship for use. The assembly table provides a centering guide plug that supports guide fingers in alternate positions. When the fingers are raised, they pass through and guide a mandrel hole of the base flange to a center position about the plug. As the base flange is positioned on the table, the guide fingers are automatically lowered to a radial position that locates and centers the drum and that further guides the through rods to proper position.

11 Claims, 6 Drawing Figures

REEL CONSTRUCTION AND ASSEMBLY APPARATUS

BACKGROUND OF THE INVENTION

Many different types of shipping and storing reels for coiled products have been developed to satisfy the usual requirements of durability, utility and economy of construction. It is likewise recognized that others have previously developed reel designs that would facilitate assembly or that would incorporate knock-down characteristics so that empty reels or reel components could be shipped more economically. For some earlier designs the present labor costs of assembly are somewhat prohibitive, and, accordingly, the savings that might be inherent in reducing the bulk size of initial reel sales shipments and empty reel return shipments are often not realized. The present development is directed to further reduction in freight and labor costs through provision of simplified reel construction features and apparatus for the assembly of reels that minimize labor costs.

SUMMARY OF THE INVENTION

Features of a preferred embodiment of the invention are briefly set forth in the abstract above and are further discernable from study of the accompanying Figures as supplemented by the description.

DESCRIPTION OF THE PREFERRED EMBODIMENTS

Figure 2:
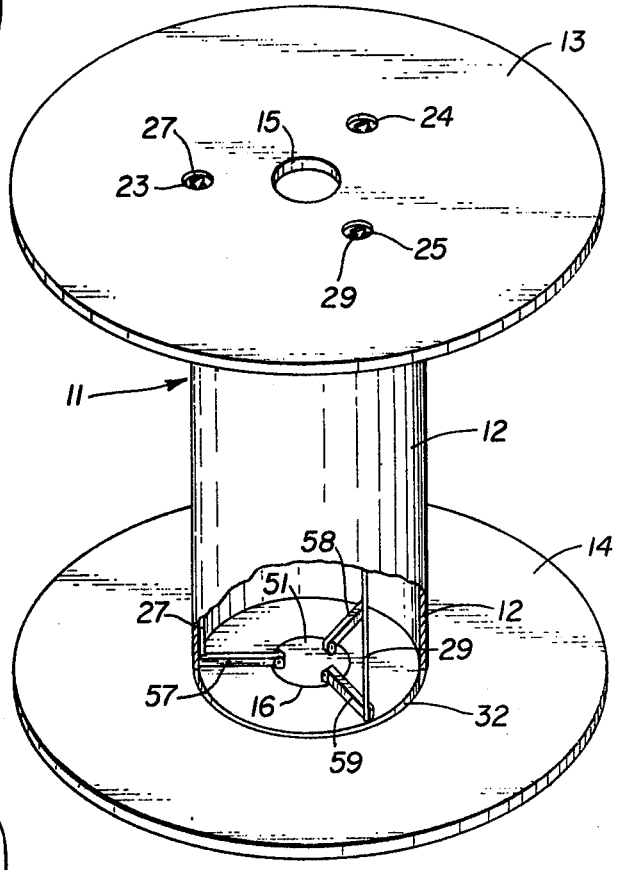
FIG. 2 is a perspective drawing in partial broken section showing the reel construction as assembled.

The assembled shipping and storage reel 11 presented in FIG. 2 is of somewhat overall conventional construction providing paired side flanges 13 and 14 that are spaced one from the other by a center drum 12. The side flanges 13 and 14 each have central mandrel openings 15 and 16, respectively, through which a mandrel or arbor can be extended when products are to be coiled onto the reel 11 or are to be dispensed therefrom. Usually the mandrel openings are of relatively small size when compared to the diameter of the flanges, and significantly such mandrel openings are not generally of a size that will admit a workman's hand or arm. Side flanges 13 and 14 are preferably made of readily available flat stock material that can be cut and milled as desired. A sturdy though economical reel 11 can be provided where the side flanges 13 and 14 are of plywood stock and the center drum 12 is of hollow laminated paper tube type material.

Figure 1:
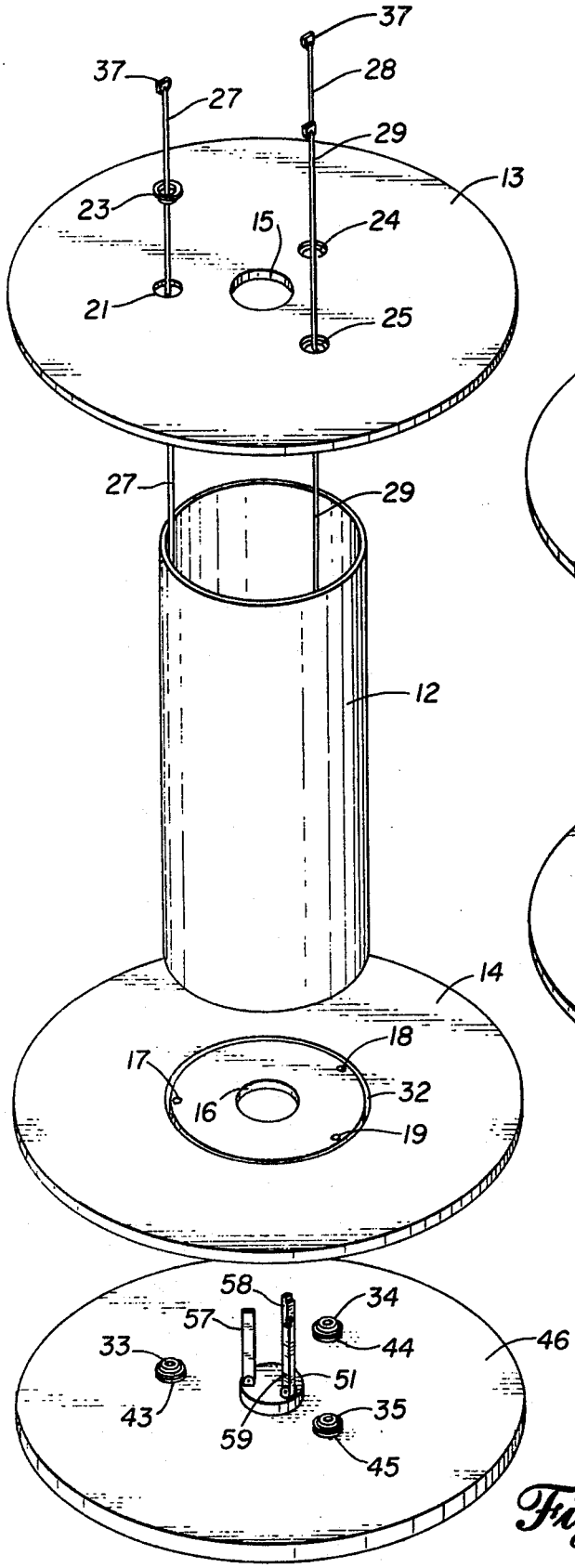
FIG. 1 is a perspective drawing of components for a reel construction shown in disassembled relationship above an assembly table.

As shown in FIG. 1, a plurality of holes, such as the holes 17, 18 and 19, are drilled through the side flanges to receive the through support rods 27, 28 and 29, respectively, Counterbores, such as counterbore 21, are provided in the outer faces of the flanges 13 and 14 at positions surrounding the through holes 17–19. Such counterbores are adapted to receive the dished washers 23, 24, and 25 that are used with the upwardly disposed or top side flange 13 or to receive the similarly formed locking washers 33, 34 and 35 that are to be positioned in similar counterbores 22 provided in the lower face of the lower or base flange 14. Actually flanges 13 and 14 are of identical construction, and, accordingly, the recesses 21 and 22 are of the same size and placement.

In addition to the openings and counterbores identified, each of the flanges 13 and 14 provide cut channel grooves 31 and 32 in the inwardly disposed faces of the flanges 13 and 14, respectively. These channel grooves are disposed concentrically with respect to the mandrel openings 15 and 16, and they are positioned just outwardly and in contact with the openings 17, 18 and 19 that accept the through rods 27, 28 and 29. The channel grooves 31 and 32 are of size and diameter to receive the central drum tube structure 12. Since the inner and outer cylindrical surfaces of the central drum tube engage the side edges of the channel grooves 31 and 32, the end edges of the tube will be supported and protected by the grooves. Further, when the reel is assembled, the described construction will be strong and durable.

Figure 6:
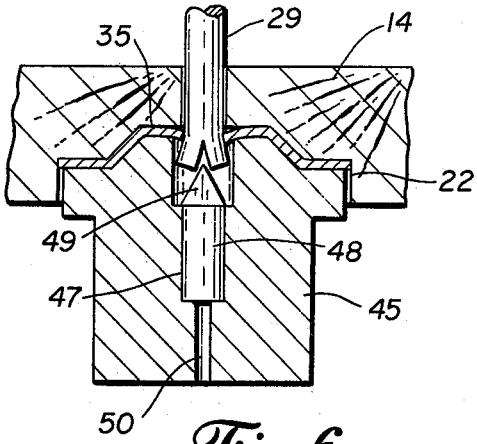
FIG. 6 is a view similar to that of FIG. 5 showing a fully staked through rod.

In order to hold the side flanges 13 and 14 and the center drum tube 12 in assembled relationship, the through rods 27–29 are extended through such components and also through the dished washers disposed in the outer faces of the separate flanges. Each of the through rods 27–29 has an upset head 37 which will not pass through the central opening of the dished washers 23–25 though the rod shanks freely pass therethrough. The depth of the counterbore recesses 21 of the top flange and the height of the upset segments 37 are regulated so that the upper end of the rod will be disposed slightly above the upper or other surface 36 for the top flange 13 when assembly operations are started. With this arrangement blows of a hammer may be directed against the upper end of the rods to drive them downwardly into secure engagement with the center openings in the locking or clinch washers 33–35. These lower clinch washers 33–35 are disposed on top of bushings 43, 44 and 45 that are disposed in receptacles provided by an assembly table 46 that preferably is of steel construction. Each of the bushings has a central bore 47 that receives a staking pin 48 having a chisel pointed end 49. The bushing 45 and staking pin 48 are of hardened metal with the staking pin preferably being of harder temper. The chisel point end 49 of the staking pins 48 is disposed slightly below the upper surface of the bushing and in position to be engaged by the free end of the rods 27–29 when they are driven through the clinch washers 33–35. The initial hammer blows that cause the rod end to pass through the clinch washers will tend to set the washers on the rods in a manner that would in itself hold the rods, washers and the entire reel assembled. In order to provide additional security, however, further hammer blows are directed against the upset end 37 of the rods to drive the free end thereof downwardly and against the chisel points 49 for the staking pins 48. The blows thus delivered mark the ends of the through rods and tend to blossom the end thereof, as shown in exaggerated detail in FIG. 6. With the ends thus staked, the rods and top and bottom dished and locking washers are securely joined each to each, and the flanges and center drum of the reel 11 are securely held in their assembled relationship.

Figure 4:
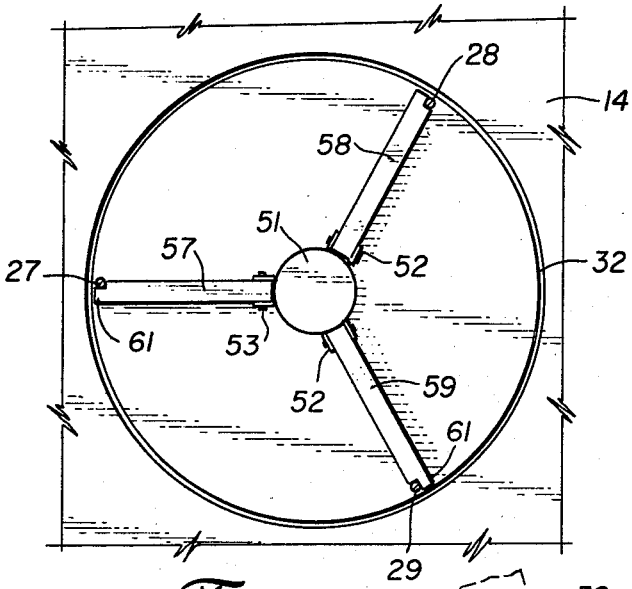
FIG. 4 is a partial top elevation during assembly and showing operative features of some assembly apparatus.
Figure 3:
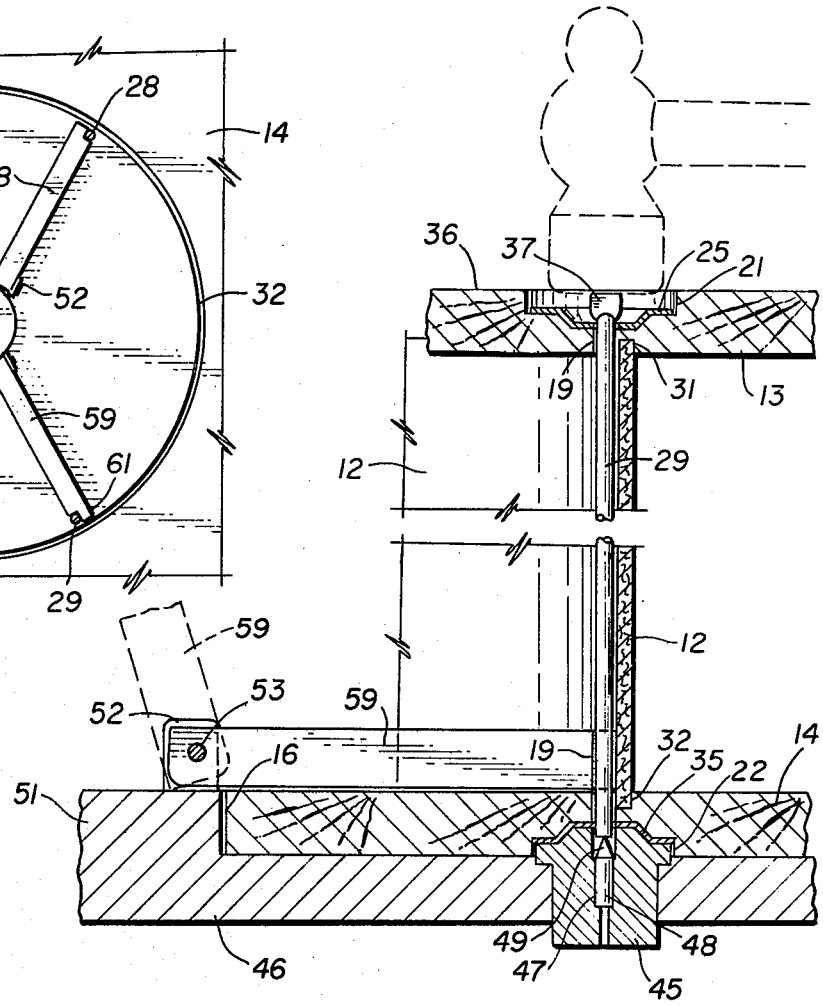
FIG. 3 is a partial broken cross-sectional elevation showing features of the reel construction and of the assembly apparatus.
Figure 5:
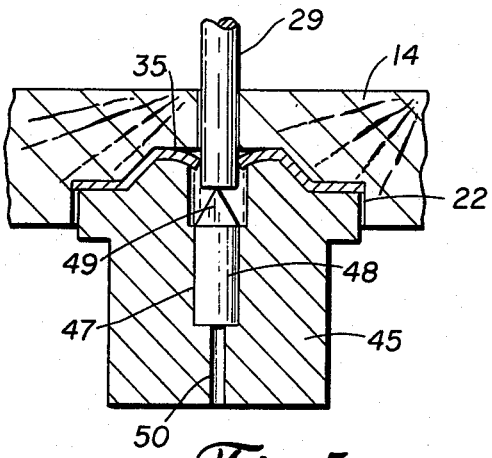
FIG. 5 is a cross-sectional view taken through a locking washer support bushing and staking pin component.

Further features of the assembly table 46 and additional components thereof are provided to facilitate the orientation and assembly of reels 11. The assembly table 46 provides a centering pedestal or plug 51 that is raised above the otherwise flat surface of the table 46. The outer diameter of the centering plug 51 corresponds to the diameter of the mandrel openings 15 and 16 for the flanges 13 and 14. With this arrangement the lower flange 14 can be disposed about the centering plug 51, and it will be held concentrically with respect thereto and with respect to the bushings 43, 44 and 45 disposed in receptacles provided by the assembly table 46. A plurality of guide arms 57, 58 and 59 are pivotally attached to yoke type supports disposed on the top surface of the centering pedestal or plug 51. The arms, as shown in FIGS. 1 and 2, may be disposed in alternate positions that are somewhat axially and radially aligned. Where three guide arms are used, they may be raised to a tripod position partially indicted by the dotted outline representation of arm 59 in FIG. 3. In this position the finger ends for all the guide arms will be in contact and in a somewhat conical disposition. When positioned thusly, the arms serve as a guide so that when the mandrel opening 16 is engaged thereabout, the base flange 14 moves downwardly toward a centered flat position on top of the assembly table 46. During such movement the edges of the mandrel opening 16 will come into a position of interference with respect to the pivotally anchored end of the guide arms. (See the dotted outline representation showing extension of the anchored end of arm 59 past the edge of mandrel opening 16.) If the flange 14 is then pushed down to its flat position about plug 51, such interference will cause the guide arms 57–59 to be rotated about their respective pivots 53 in the yoke supports 52 until they assume the radial disposition shown in FIGS. 4 and 2. When the guide arms are in this lowered position, the outermost surfaces of finger extensions 61 will be in position to locate and center the tube structure of the center drum 12 so that this structure will be guided into engagement in the channel groove 32. After the drum component 12 is positioned, the top flange 13 will be applied, and thereafter the rods 27–29 will be inserted through the respective openings 17–19. When the top flange is in place, the interior enclosed space will be considerably darkened, and it is then hard for the workman to find and locate the openings 17–19 in the lower base flange 14 so that the rods may be inserted therethrough. The finger extensions 61 provided at the outer limits of the radially disposed guide arms 57–59 then facilitate proper location of the through rods, since the lower free ends of the rods can simply be moved along the top surface of the base flange 14 and circumferentially about the inner surface of the drum 12 until the rods come into contact with the fingers 61 for the guide arms. When in such position, the rods will be directly aligned with the openings 17–19 in the base flange and with the central openings of locking washers 33–35 then disposed on bushings 43–45. The remaining assembly operations inclusive of the hammer blows directed against the top exposed ends of the through rods are then undertaken to provide the rigid and sturdy reel construction desired.

Basically, this rod staking operation, which is accomplished without having to have access to the end that is to be staked, is believed to be an improvement in the reel construction field. The assembly operations are considerably expedited in keeping with such procedure, while the security of the reel assembly is improved. Both ends of the through rods are securely held in place and tightly engaged with their respective force distributing washers. When the length of the rod is closely controlled, neither the upset or otherwise headed end nor the staked end will extend beyond the surface of the flanges and there is accordingly no obstruction which will prevent independent turning of the reels even though a plurality of reels are disposed in side-by-side relationship on a single arbor.

Several features of the assembly table and the tie rod staking components thereof can be used irrespective of whether or not the guide arms are provided. For some reel assemblies where the mandrel opening is quite small and the center drum is relatively large, it may be difficult to provide guide arms and fingers that will pass through the mandrel or arbor opening. For reels of this type and for reel assemblies of large size having large arbor openings, a light can be positioned on top of the center plug. An ordinary incandescent bulb can be positioned at the central plug 51 to illuminate the interior of the drum thereby facilitating visual alignment and placement of the through rods with respect to the openings in the lower flange and, accordingly, with respect to the rod end upsetting bushing assemblies 45, etc.

Since a single table may be used for the fabrication of many different reel sizes, a plurality of concentrically disposed holes may be provided in the assembly table 46 for the reception of bushings 45. For different reels, three, five, six or any other number of through rods may be used as necessary to provide a strong and sturdy reel construction.

Reels constructed in accordance with this invention and fabricated on the apparatus disclosed herein can be assembled at various points of use at low cost. With a low labor cost and a simplified assembly operation, it is advantageous to ship the reel components to points of use in disassembled relationship to derive a considerable savings in freight costs. If the reels are to be reused, ordinarily only the flanges or the flanges and center tube are conserved and return-shipped to manufacturers or conduit suppliers, since the through rods and washers are of a relatively minor cost.

I claim:

1. Apparatus for use when assembling reel structures that include a center drum disposed between first and second side flanges, each of which provide a mandrel opening, comprising an assembly table, a raised central plug on said table of size corresponding to the size of said mandrel openings for centering said second flange on said table, a plurality of pivotally mounted guide arms disposed above said central plug for movement to alternate axial and radial positions, guide fingers on the terminal free ends of said guide arms, said guide arms in the axially directed position providing outwardly disposed action surfaces for engagement in the mandrel opening of said second flange to move said second flange toward a centered position, and said guide fingers in the radially disposed position providing means for contacting inner surfaces of said center drum to center said drum.

2. The reel assembly apparatus as set forth in claim 1 for use with reels wherein the flanges and center drum are held in assembled relationship by a plurality of straight shank through rods extending between said first and second flanges, and further comprising bushings disposed on said assembly table at positions corresponding to the intended positioning of said through rods for the reception of free ends of said rods that have been extended through an upwardly disposed top or first flange, through said center drum and the bottom second flange, and striking surfaces provided at said bushings whereby blows directed at the upper exposed ends of said rods adjacent said first flange will cause the lower free end of said rods at said bushings to be expanded for holding said reels in assembled relationship.

3. The reel assembly apparatus as set forth in claim 2 and further comprising staking pins disposed at said bushings and providing said striking surfaces.

4. The reel assembly apparatus of claim 2 for use as set forth therein and wherein the reel assembly elements to be used are inclusive of a plurality of locking washers having central openings of lesser size than the size of said rod shanks and further comprising centering surfaces on said bushings for cooperative mating engagement with said locking washers for holding said locking washers centered on said bushings, said bushings further providing openings of size greater than the size of said rod shanks for the reception of said rod shanks whereby the blows directed at the upper exposed ends of said rods will move the free ends of said rods forcefully through the central openings of the locking washers and into secure engagement one with the other.

5. The reel assembly apparatus as set forth in claim 4 and further comprising staking pins disposed at said bushings and providing said striking surfaces for the expansion of the free ends of said rods whereby the locking washers are more securely held thereon.

6. The reel assembly apparatus as set forth in claim 1 wherein said outwardly disposed action surfaces of said guide arms when the guide arms are in the axially directed position are inclusive of portions extending radially outward of said central plug and the pivotal mounts for said arms whereby said guide arms are moved toward the radially directed position as the mandrel opening for either flange is moved to centered position on said assembly table.

7. The reel assembly apparatus of claim 6 for use as set forth therein and wherein the reel assembly elements to be used are inclusive of a plurality of straight shank through rods for extending interiorly of said drum and between and through rod openings provided by said first and second flanges, and further comprising guide fingers on said guide arms for contacting relationship with the inner surface of said center drum when the guide arms are in the radially extending position to provide with said center drum means for guiding the said through rods to rod openings in said second flange.

8. Apparatus for use when assembling reel structures that include a center drum disposed between first and second side flanges, each of which provide a mandrel opening, and a plurality of straight shank through rods extending between said first and second flanges for holding the flanges and center drum in assembled relationship comprising an assembly table, a raised central plug on said table of size corresponding to the size of said mandrel openings for centering said second flange on said table, bushings disposed on said assembly table at positions corresponding to the intended positioning of said through rods for the reception of free ends of said rods that have been extended through an upwardly disposed top of first flange, through said center drum and the bottom second flange, and striking surfaces provided at said bushings whereby blows directed at the upper exposed ends of said rods adjacent said first flange will cause the lower free end of said rods at said bushings to be expanded for holding said reels in assembled relationship.

9. The reel assembly apparatus as set forth in claim 8 and further comprising staking pins disposed at said bushings and providing said striking surfaces.

10. The reel assembly apparatus of claim 8 for use as set forth therein and wherein the reel assembly elements to be used are inclusive of a plurality of locking washers having central openings of lesser size than the size of said rod shanks and further comprising centering surfaces on said bushings for cooperative mating engagement with said locking washers for holding said locking washers centered on said bushings, said bushings further providing openings of size greater than the size of said rod shanks for the reception of said rod shanks whereby the blows directed at the upper exposed ends of said rods will move the free ends of said rods and the locking washers into secure engagement one with the other.

11. The reel assembly apparatus as set forth in claim 10 and further comprising staking pins disposed at said bushings and providing said striking surfaces for the expansion of the free ends of said rods whereby the locking washers are more securely held thereon.

* * * * *